US006148724A

United States Patent [19]

Hart et al.

[11] Patent Number: 6,148,724

[45] Date of Patent: Nov. 21, 2000

[54] SELECTIVE FLEXOGRAPHIC PRINTING

[75] Inventors: Philip T. Hart, Tonawanda; Jimmie A. Harrod, Grand Island; Henk Haan, Niagara Falls, all of N.Y.

[73] Assignee: Moore Business Forms, Inc., Grand Island, N.Y.

[21] Appl. No.: 08/359,697

[22] Filed: Dec. 20, 1994

[51] Int. Cl.[7] ..... B41F 5/06

[52] U.S. Cl. ..... 101/182; 101/181; 101/222; 101/224; 101/484

[58] Field of Search ..... 101/179–185, 101/216, 219, 220–223, 224, 225, 228, 424.1, 483–486, 489, DIG. 36, DIG. 37, DIG. 43; 400/82; 346/44; 347/120

[56] References Cited

U.S. PATENT DOCUMENTS

| | | | |
|---|---|---|---|
| 3,697,101 | 10/1972 | Loos et al. | 283/62 |
| 3,892,427 | 7/1975 | Kraynak et al. | 281/15.1 |
| 3,899,381 | 8/1975 | O'Brien et al. | 156/204 |
| 3,911,818 | 10/1975 | MacIlvane | 101/494 |
| 3,913,719 | 10/1975 | Frey | 400/61 |
| 3,982,744 | 9/1976 | Kraynak et al. | 270/12 |
| 3,982,746 | 9/1976 | O'Brien et al. | 270/37 |
| 3,993,299 | 11/1976 | O'Brien et al. | 270/5.01 |
| 3,994,225 | 11/1976 | Sitzberger | 101/485 |
| 4,155,093 | 5/1979 | Fotland et al. | 347/127 |
| 4,160,257 | 7/1979 | Carrish | 347/127 |
| 4,195,927 | 4/1980 | Fotland et al. | 355/277 |
| 4,267,556 | 5/1981 | Fotland et al. | 347/127 |
| 4,282,297 | 8/1981 | Fotland et al. | 430/48 |
| 4,328,749 | 5/1982 | Inouye et al. | 101/142 |
| 4,365,549 | 12/1982 | Fotland et al. | 347/127 |

(List continued on next page.)

FOREIGN PATENT DOCUMENTS

| | | |
|---|---|---|
| 2059036 | 7/1992 | Canada . |
| 2101807 | 2/1994 | Canada . |
| 2108924 | 6/1994 | Canada . |
| 2121417 | 10/1994 | Canada . |
| 0 175 516 | 3/1986 | European Pat. Off. . |
| 0 527 552 | 2/1993 | European Pat. Off. . |
| 0 569 633 | 11/1993 | European Pat. Off. . |
| 0587322 | 3/1994 | European Pat. Off. . |
| 0 594 989 | 5/1994 | European Pat. Off. . |
| 01240423 | 12/1993 | Italy . |
| 1 214 639 | 12/1970 | United Kingdom . |
| 1 498 981 | 1/1978 | United Kingdom . |
| 2 161 752 | 1/1986 | United Kingdom . |
| WO 92/09435 | 6/1992 | WIPO . |
| WO 92/20525 | 11/1992 | WIPO . |
| WO 94/00298 | 6/1994 | WIPO . |

OTHER PUBLICATIONS

Stobbe, "Ion Deposition Printing", *FLEXO*, Dec. 1993, pp. 76and 77.

"The Highly Variable Image of Information Technology", *Forms International*, Mar. 1993, two pages.

(List continued on next page.)

*Primary Examiner*—Stephen R. Funk
*Attorney, Agent, or Firm*—Nixon & Vanderhye P.C.

[57] ABSTRACT

A web of paper is printed with selective non-variable information and vastly different variable information on portions of the paper web which are ultimately separated into discrete documents. At least one ion deposition print unit and a number of flexographic print units are utilized, as well as a data source containing at least the variable information, and first and second computers. Data is read from the data source with the first computer and in response to the read data the ion deposition print unit is controlled with the first computer to print variable information on the paper web. Form lag commands are provided from the first computer to the second computer. In response to the lag commands the flexographic print units are independently controlled by the second computer to operatively engage and disengage the paper web and thereby print non-variable information from at least one of the flexographic units on each discrete document portion of the paper web. Ink applied with the flexographic units is typically UV cured. Video inspection takes place after application of the variable and non-variable information.

19 Claims, 4 Drawing Sheets

U.S. PATENT DOCUMENTS

| | | | |
|---|---|---|---|
| 4,379,969 | 4/1983 | Cobb et al. | 250/324 |
| 4,381,327 | 4/1983 | Briere | 428/137 |
| 4,408,214 | 10/1983 | Fotland et al. | 347/128 |
| 4,409,604 | 10/1983 | Fotland | 347/127 |
| 4,448,872 | 5/1984 | Vandervalk | 430/126 |
| 4,514,781 | 4/1985 | Plasschaert et al. | 361/230 |
| 4,679,060 | 7/1987 | McCallum et al. | 347/127 |
| 4,745,421 | 5/1988 | McCallum et al. | 347/127 |
| 4,789,147 | 12/1988 | Berger et al. | 270/1.03 |
| 4,805,501 | 2/1989 | Nuttin | 83/300 |
| 4,918,464 | 4/1990 | Isshiki | 347/215 |
| 4,951,223 | 8/1990 | Wales et al. | 101/486 |
| 4,966,352 | 10/1990 | Nuttin | 101/211 |
| 4,989,850 | 2/1991 | Weller | 270/1.02 |
| 4,999,653 | 3/1991 | McCallum | 347/127 |
| 5,006,869 | 4/1991 | Buchan et al. | 347/127 |
| 5,030,977 | 7/1991 | Hanson et al. | 347/140 |
| 5,086,700 | 2/1992 | Van Den Berg | 101/424.1 |
| 5,102,737 | 4/1992 | Josephy et al. | 347/264 |
| 5,107,284 | 4/1992 | Cyman et al. | 347/126 |
| 5,114,128 | 5/1992 | Harris, Jr. et al. | 270/1.03 |
| 5,114,291 | 5/1992 | Hefty | 412/8 |
| 5,117,610 | 6/1992 | Hartman et al. | 101/490 |
| 5,132,713 | 7/1992 | Christy et al. | 347/152 |
| 5,233,919 | 8/1993 | Fecteau et al. | 101/228 |
| 5,243,363 | 9/1993 | Koizumi et al. | 347/50 |
| 5,294,513 | 3/1994 | Mitchell et al. | 430/109 |
| 5,297,488 | 3/1994 | Bunch, Jr. | 101/182 |
| 5,323,217 | 6/1994 | Christy et al. | 355/297 |
| 5,429,698 | 7/1995 | Hartman et al. | 156/250 |
| 5,520,109 | 5/1996 | Meschi | 101/247 |

OTHER PUBLICATIONS

One page flyer entitled "Printger Perect Massive Mailings".

Stenulis et al, "Crossing the Road Into the New Age of Sheetfed Technology", *High Volume Printing*, two pages.

"Printer Allows Variable Info In Single Pass", *Paper Film & Foil Converter*, Jul. 1991, one page.

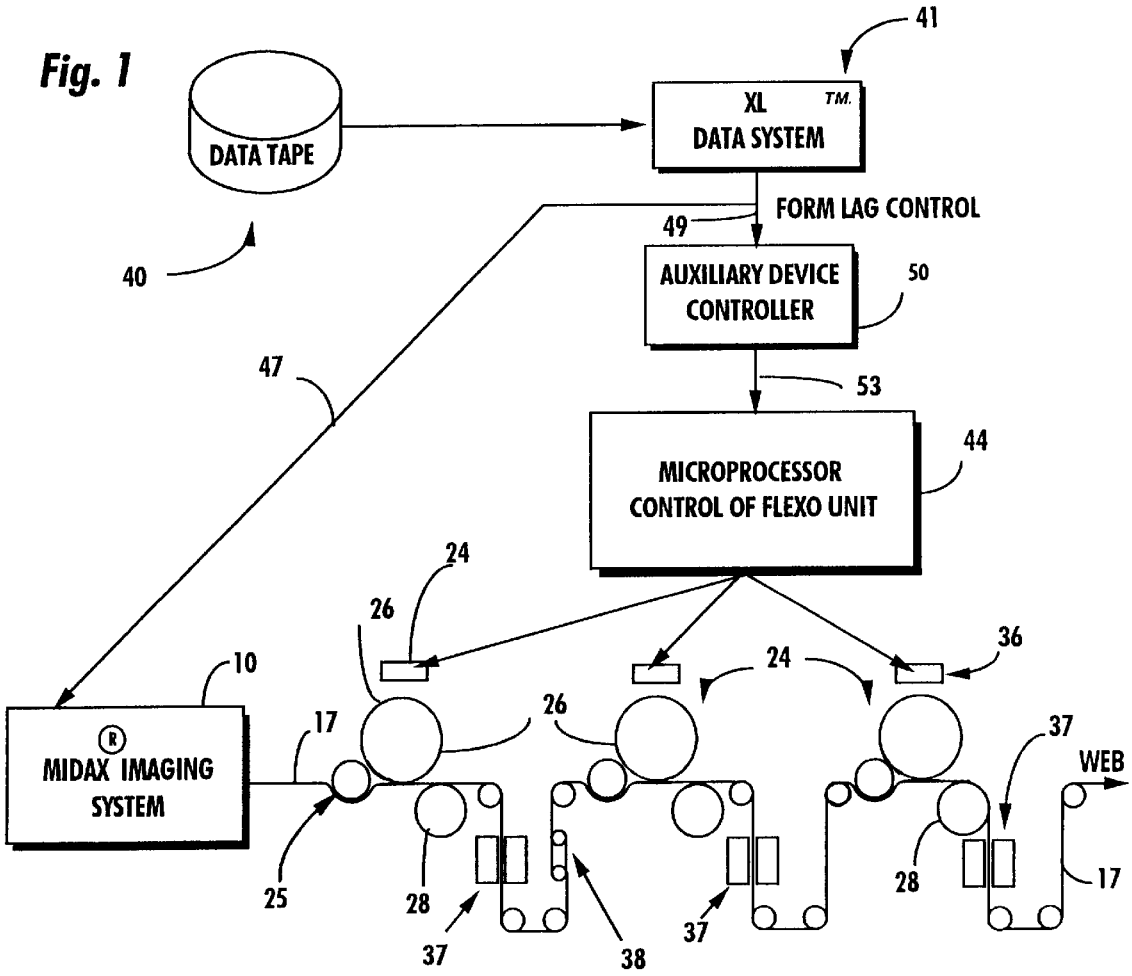
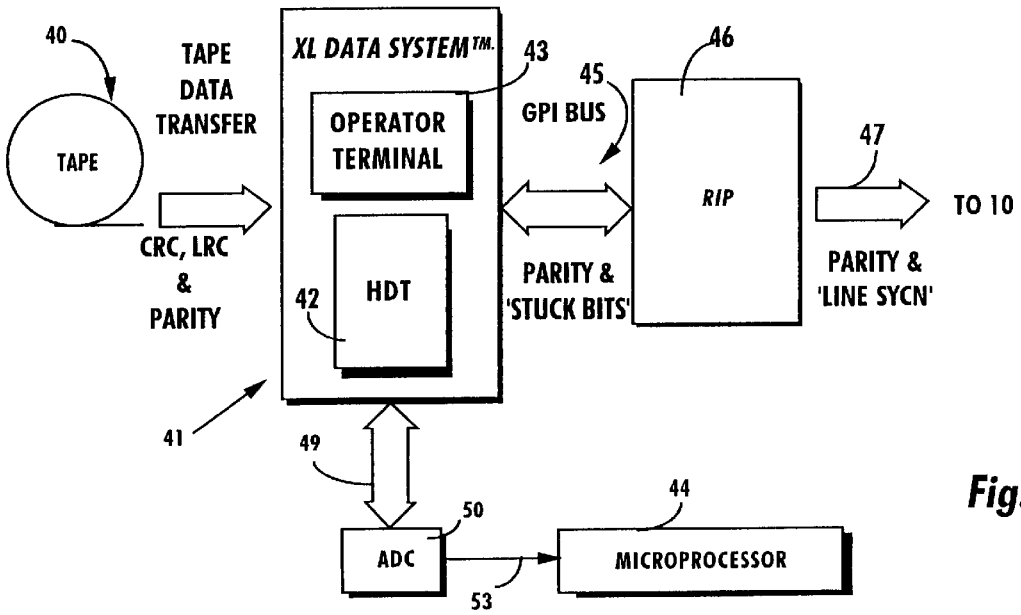
Fig. 2

SELECTIVE FLEXOGRAPHIC PRINTING

BACKGROUND AND SUMMARY OF THE INVENTION

There are a number of situations in which it is desirable to substantially simultaneously print a web of paper to produce discrete documents with selective non-variable information and vastly different variable information, rather than printing the variable and non-variable information at different locations. For example in the printing of telephone bills, it is necessary to print header information, promotional information, and other standard essentially non-variable information on different portions of a discrete document which will serve as an individual telephone bill (for a company or a person), while at the same time printing vastly different variable information in the form of customer information (such as name, address, phone numbers, etc.), phone calls made (such as the number of local units used, the long distance phone numbers called with time, date, duration, and the like) and charging information (standard charges, taxes, discounts, individual charges for long distance calls, etc.). For high volume businesses it is important that this printing be done quickly and accurately (so that downtime is small and/or so that information can be reprinted if there is a problem with the printing process and the web is interrupted).

According to the present invention a method and apparatus (including flexographic units) are provided which allow the substantially simultaneous printing of a web of paper to produce discrete documents with selective non-variable information and vastly different variable information in a quick, accurate, and efficient manner, and overcoming the problems discussed above. One of the most significant benefits of the invention is the ability to produce discrete documents, with varying numbers of pages, which consist of both non-variable (color) and variable printed information during a single pass, continuous printing operation. This ability provides a means to produce documents (e.g. billing statements) with varying numbers of pages, sorted by postal code (to take advantage of postal rate discount), in a single pass through the printing operation.

Using traditional methods, it would be necessary to print the bill header page (which would be limited to one repeat size, one page) on a separate pass through a flexographic press, to create (pre-print) a discrete web (roll) of one page documents. A second operation of applying variable information would require the pre-printed web to be re-introduced to a variable data printing system. Additional webs, requiring variable information, necessary to create two page, three page, and longer documents, would need to be variably imaged, and the data matched and collated together with the pre-print header page (this is very difficult to do, especially with documents in excess of three pages). A third operation of co-mingling one page documents, two page documents, three page documents, etc., of the same postal code would be required to achieve the same results as obtained in a single pass through the selective flexographic printing system of the invention. Therefore, the selective flexographic system of the invention significantly reduces additional time, labor and waste. It also provides the ability to produce documents in excess of three pages (e.g. up to 8 pages), which likely would be unachievable using traditional methods.

The printing according to the invention may be done in three or four colors, and one or both faces of the web may be printed. The components are commercially available, but configured in a particular way that is highly advantageous.

According to one aspect of the present invention a method of (e.g. substantially simultaneously—i.e. multiple pages are printed on the web at approximately the same time) printing a web of paper to produce discrete documents with non-variable information and vastly different selective variable information on portions of the paper web ultimately to be separated into discrete documents, utilizing at least one ion deposition print unit and a plurality of flexographic print units, a data source containing at least the variable information, and first and second computers, is provided. The method comprises the following steps: (a) Reading data from the data source with the first computer. (b) In response to the read data from the data source, controlling the ion deposition print unit with the first computer to print variable information on the paper web. (c) Providing form lag commands from the first computer to the second computer. And, (d) in response to the form lag commands, independently controlling the flexographic print units with the second computer to operatively engage and disengage the paper web and thereby print non-variable information from at least one of the flexographic units on each discrete document portion of the paper web. Each flexographic unit is capable of printing a unique non-variable format on demand (or command) from an operator/computer. The exact format of the non-variable information is determined by a printing plate installed on a printing cylinder of the flexographic unit.

There is typically the further step of UV curing ink applied with each of the flexographic units substantially immediately after it has been applied, and there is also the further step of video inspecting the web after application of the variable and non-variable information. A second ion deposition unit may also be provided in which case there is the further step (e) in response to the read data from the data source, controlling the second ion deposition print unit with the first computer to print variable information on the paper web. There may also be the further step of video inspecting the web before printing thereof with the first ion deposition unit and after printing with the second ion deposition unit, and separately after printing with all print units. The method steps are typically practiced at a speed of at least 300 feet per minute, e.g. at least 330 feet per minute and perhaps as high as 500 per minute. The steps may be practiced to print phone bills, with headers and standard information being printed by the flexographic units, and phone calls made, customer, and charging information printed by one or both of the ion deposition units, although a wide variety of documents may be printed. Steps (a)–(d) may be further practiced to produce documents having three or more pages, and including a postal code printed on a first page on which the header is printed, and further comprising the step of separating the multi-page documents by postal code.

If desired there may be the further step of turning the web so that the relative positions of the first and second faces of the web reverse between flexographic print units so that both faces of the webs may be printed. Also the second computer typically has a video monitor and an input device, and there may be the further step of re-configuring the control of the flexographic print units by inputting information into the second computer using the input device, and viewing the inputted information and results of inputting the information using the video monitor.

The invention also relates to a printing system for substantially simultaneously printing a web of paper to produce discrete documents with non-variable information and different variable information on portions of the web ultimately to be separated into discrete documents. The printing system comprises the following components: A paper web unwind unit. At least one ion deposition print unit operatively connected to the paper web unwind unit. A plurality of flexographic print units located on the opposite side of the ion deposition print unit from the paper unwind unit, and operatively connected to the paper unwind unit. A paper web handling unit on the opposite side of the flexographic print units from the ion deposition print unit. First and second computers, the first computer for reading data from a data source containing at least the variable information. And, interconnections between the first computer and the ion deposition print unit and second computer, and between the second computer and the flexographic print units, effecting, in response to the read data from a data source, control of the ion deposition print unit with the first computer to print variable information on the paper web; providing form lag commands from the first computer to the second computer; and in response to the form lag commands, independently controlling the flexographic print units with the second computer to operatively engage and disengage the paper web.

The paper web handling unit may comprise a pull roll module and a paper web rewind, although it may also comprise means for separating the web into discrete documents at essentially the same location that the printing takes place, or other cutting, slitting, punching, and/or perforating units.

Typically the ion deposition print unit comprises a MIDAX® (e.g. 322 print engine) unit, which is available from Moore Business Forms, Inc. of Lake Forest, Ill. That unit comprises a toner hopper, toner developer roll, image cylinder, ion cartridge, pressure roll, cleaning station, and erase rod, the paper web passing between the image cylinder and pressure roll, and the developer roll upstream of the image cylinder in the direction of paper web movement, and the cleaning station and erase rod downstream of the image cylinder in the direction of paper web movement.

Each of the flexographic units may comprise a WEBTRON® unit, and the flexographic units in combination may comprise a WEBTRON® 1000 three-color flexographic press. Each flexographic print unit may comprise an ink metering roll engaging an anilox roll, an impression cylinder, and a plate cylinder having a flexible material plate around at least part of the periphery thereof, the plate on the plate cylinder engaging the anilox roll, and the paper web passing between the plate on the plate cylinder and the impression cylinder.

Video inspection is preferably also provided at at least one place along the web after printing, and preferably at two different places. The web inspection unit may comprise a PROMARK® video web inspection system.

The first computer preferably comprises an XL DATA SYSTEM™, available from Moore Business Forms, Inc. of Lake Forest, Ill., which is typically connected to the MIDAX® print engine through a raster image processor (RIP). The second computer may comprise a conventional PC.

According to yet another aspect of the present invention a printing system is provided comprising the following elements: At least three flexographic print units. At least one ion deposition print unit. At least one video inspection unit. A paper web unwind. A paper web rewind. And, the paper web rewind being downstream of the paper web unwind in a direction of paper web movement, and the video inspection unit being downstream of the print units, and the print units disposed between the paper web unwind and the video inspection unit.

It is the primary object of the present invention to provide the quick and accurate and effective substantially simultaneous printing of a web with non-variable and variable information, e.g. to print discrete documents such as phone bills. This and other objects of the invention will become clear from an inspection of the detailed description of the invention and from the appended claims.

BRIEF DESCRIPTION OF THE DRAWINGS

FIG. 1 is a schematic view illustrating control of various components of exemplary apparatus according to the present invention, for practicing the method of the present invention;

FIG. 2 is a schematic control diagram illustrating interconnections between several of the components of FIG. 1;

DETAILED DESCRIPTION OF THE DRAWINGS

Figure 3:
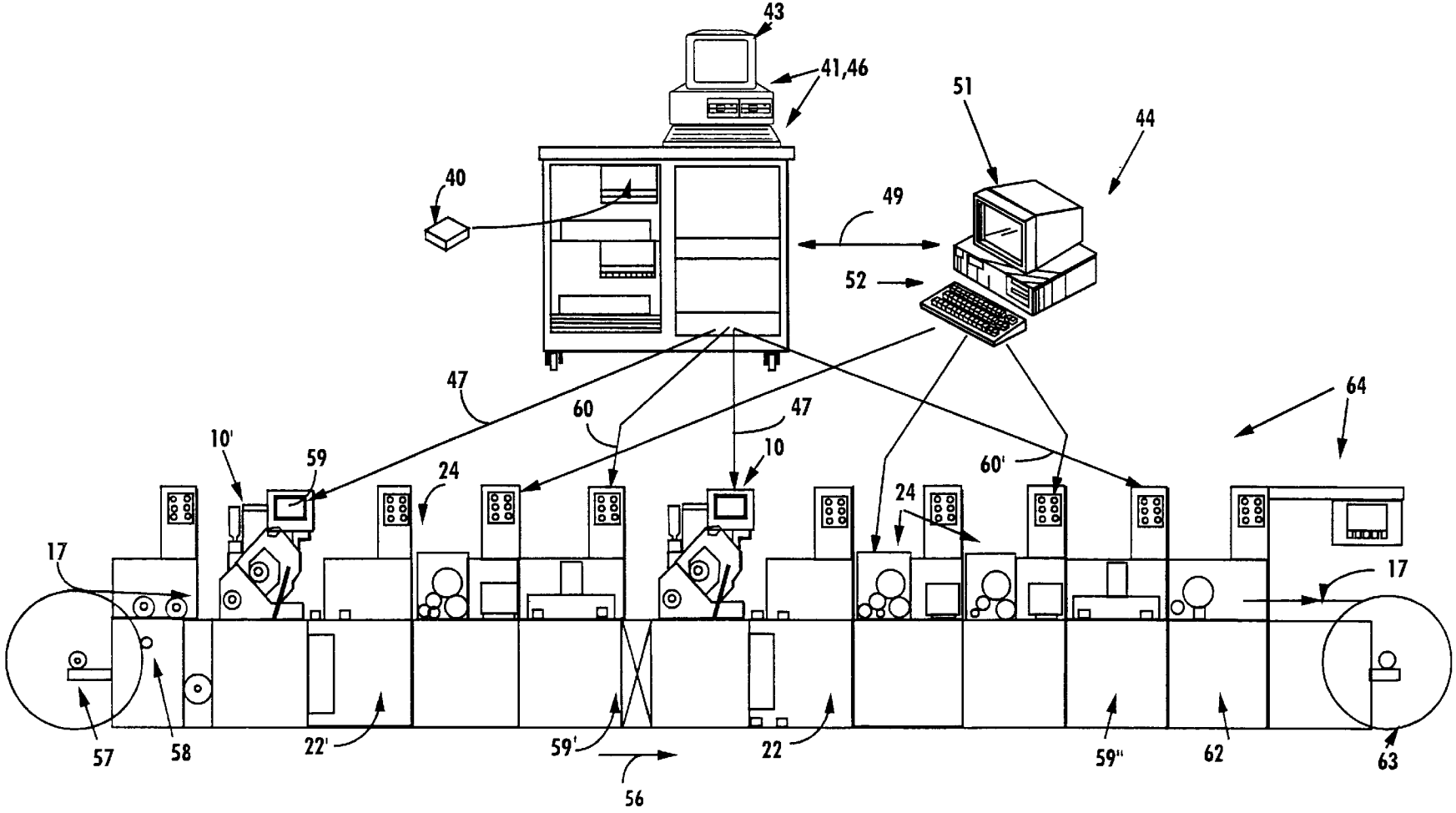
FIG. 3 is a schematic view, primarily a side view but some components shown in perspective, illustrating exemplary apparatus according to the present invention.

FIG. 1 schematically illustrates various apparatus components utilizable in the practice of the present invention. The apparatus includes a first ion deposition print unit, shown by reference numeral 10. Such a unit may be a MIDAX® imaging system, including a MIDAX® 300 (e.g. 322) print engine commercially available from Moore Business Forms, Inc. of Lake Forest, Ill. An exemplary schematic MIDAX® engine is seen generally by reference numeral 11 in FIG. 4.

Figure 4:
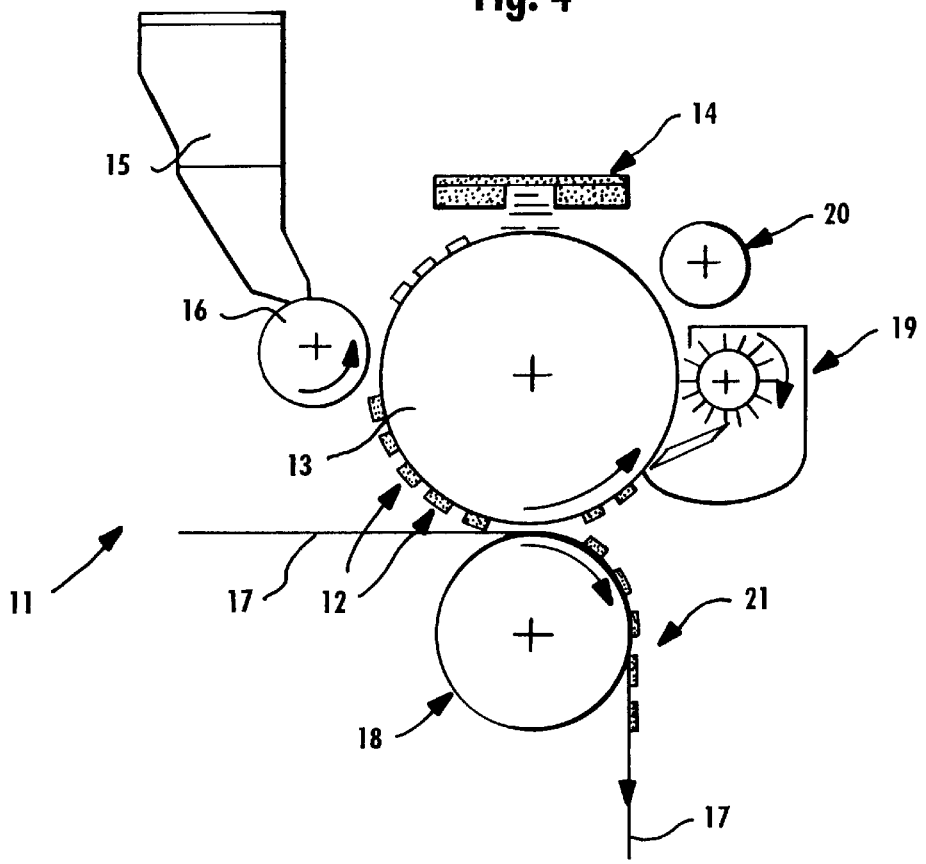
FIG. 4 is a schematic side view of an exemplary ion deposition print unit according to the present invention.

The engine 11 operates by producing a latent electrostatic image—shown schematically at 12 in FIG. 4—on an image cylinder 13 using an ion print cartridge 14, such as a DELPHAX® print cartridge. The latent electrostatic image is developed by a special toner supplied from a toner hopper 15 via a toner developer roll 16 to the image cylinder 13. The toned image is transferred to the moving paper web 17 (moving in the direction of the arrows) which passes between the image cylinder 13 and a pressure roll 18. The image cylinder 13 is skewed in relationship to the pressure roll 18 to allow a wiping action which helps press the toner onto the web, the transfer to the web being approximately 99.7% efficient. At a cleaning station 19 any residual toner that remains on the image cylinder is removed, and any electrostatic image that remains on the cylinder is neutralized by an erase rod 20. The image cylinder 13 and erase rod 20 are also preferably DELPHAX® products.

The image 21 which is transferred to the paper web 17 is fused in a fusing tower which uses infrared energy to fuse the toner onto the web, an exemplary conventional fusing station being shown schematically at 22 in FIG. 3.

In the MIDAX® system 10 the typical ion deposition, web fed print engine is shown in U.S. Pat. No. 5,132,713 (the disclosure of which is hereby incorporated by reference herein), and various electrostatic toning, imaging, and charging components associated therewith are shown in Canadian patent 2059036, and U.S. Pat. Nos. 4,195,927, 4,282,297, 4,379,969, 4,365,549, 4,409,604, and 4,514,781. The ion print cartridge 14 may be of the type such as shown in U.S. Pat. Nos. 5,243,363, 5,107,284, 4,918,464, 4,155,093, 4,160,257, 4,267,556, 4,381,327, 4,408,214, 4,679,060, 4,745,421, and/or 4,999,653. The erase rod 20 may be such as shown in Canadian patent 2108924. The image cylinder 13 may be such as shown in U.S. Pat. Nos. 5,006,869, 4,195,927, or 4,448,872. While the toner utilized may be from a wide variety of sources, it may include toner such as shown in U.S. Pat. No. 5,294,513 or Canadian patents 2,121,417 and 2,101,807. The cleaning station 19 may include the unit such as shown in U.S. Pat. No. 5,323,217.

The apparatus of FIG. 1 also includes a plurality of flexographic print units 24. The flexographic units in general preferably comprise part of a WEBTRON® 1000 three-color flexographic press, the ion deposition unit 10 and other components as illustrated in FIG. 3 being integrated into the WEBTRON® press.

Figure 5:
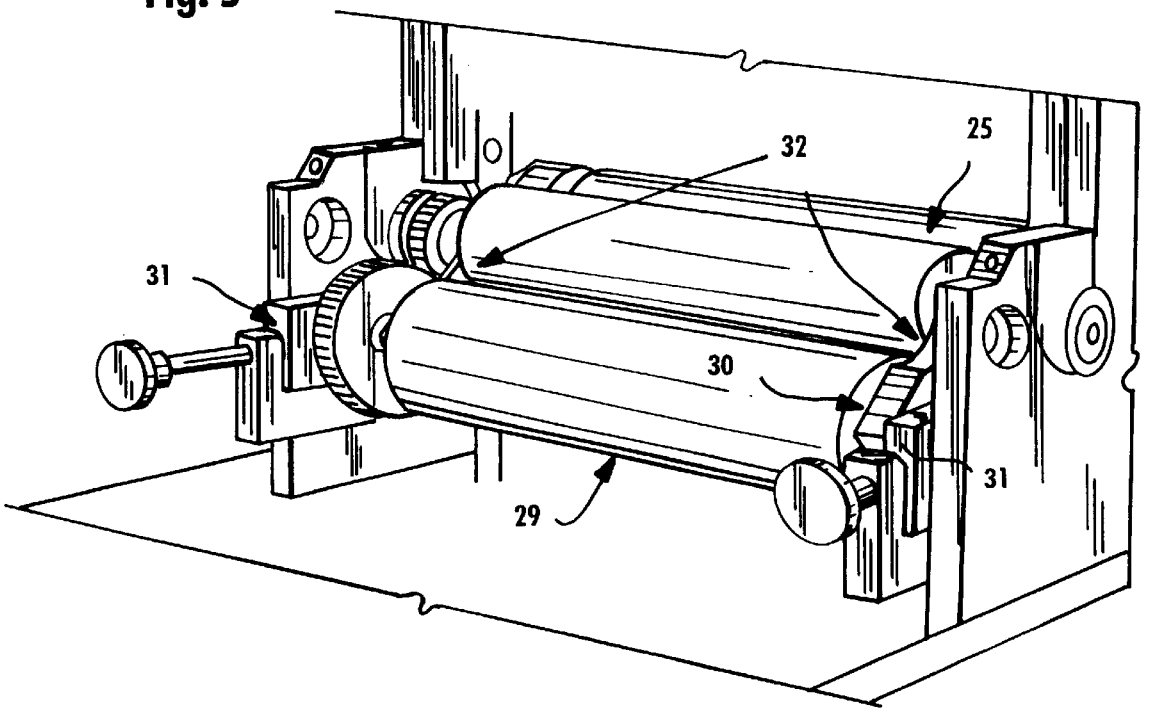
FIG. 5 is a perspective view of a part of an exemplary flexographic print unit according to the present invention.
Figure 6:
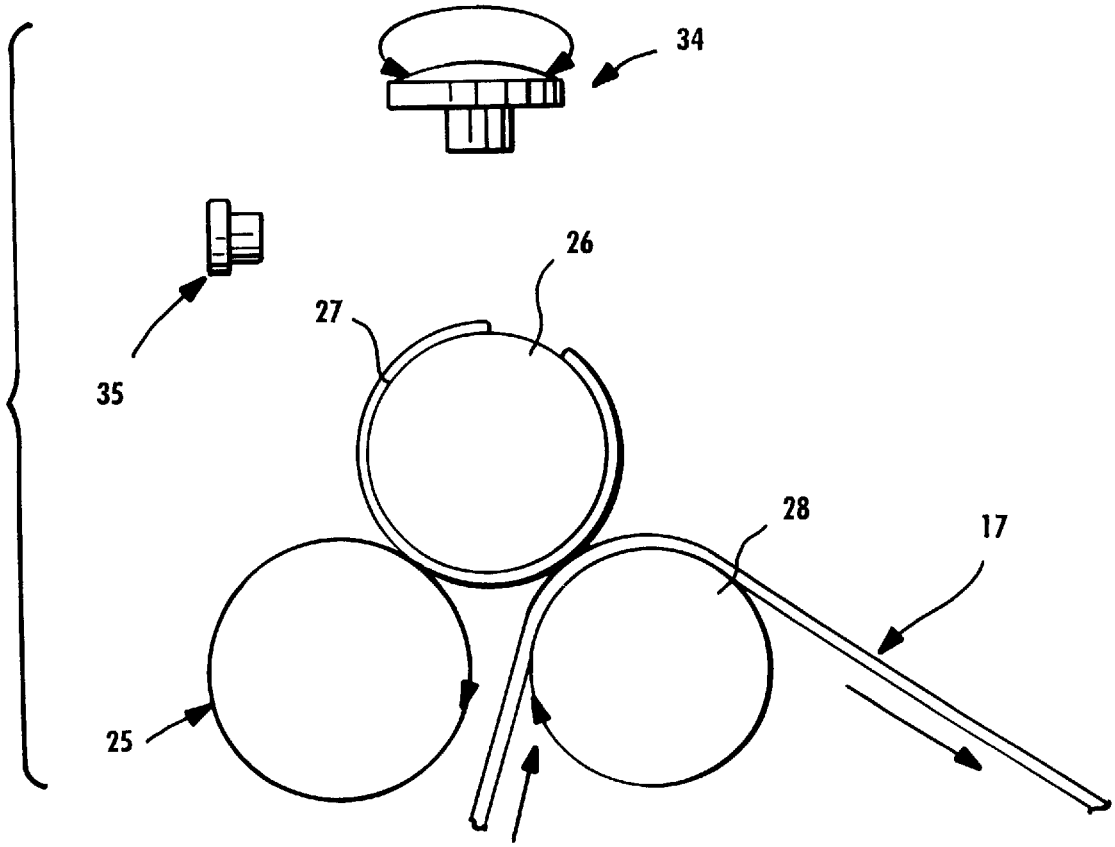
FIG. 6 is a schematic side view of some of the components from FIG. 5 shown in association with other portions of an exemplary flexographic print unit according to the invention.

Typical components of each of the flexographic print units 24, are illustrated schematically in FIG. 1, and in somewhat more detail in FIGS. 5 and 6. Each unit 24 preferably includes an anilox roll 25, a plate cylinder 26 having a rubber or like flexible material printing plate 27 (see FIG. 6) covering at least a part of the periphery thereof, and an impression cylinder 28. Ink is applied to the flexible printing plate 27 by the anilox roll 25, and ink is supplied to the anilox roll 25 using a conventional ink metering roll 29 (see FIG. 5). The roll 29 is typically neoprene covered and an ink wiper 30 is associated with it. Pressure blocks 31 provide adjustment for light contact between the ink metering roll 29 and the anilox roll 25, and plastic foam wiper blocks 32 are mounted in ink wiper pockets. A conventional doctor blade (not seen in FIG. 5) controls the ink between the rolls 29, 25.

The paper web 17 typically takes the path illustrated in FIG. 6 between the flexible printing plate 27 and the impression cylinder 28. Conventional vertical and horizontal adjustments are illustrated schematically in FIG. 6 by the vertical adjustment component 34 and the horizontal adjustment component 35. The conventional selective plate cylinder throw-off mechanism is illustrated schematically at 36 in FIG. 1, such a throw-off unit being associated with each of the flexographic print units 24.

Each of the flexographic units 24 typically includes a conventional UV curing unit (for supplying ultraviolet radiation for curing the ink after application on the web 17) associated therewith, such UV curing units being shown schematically at 37 in FIG. 1. If desired a conventional turn bar, shown schematically at 38 in FIG. 1, may be provided between two of the units 24 for reversing the face of the web 17 that will be brought into contact with printing units (e.g. units 24) downstream thereof in the direction of web movement.

FIGS. 1 through 3 show various control components associated with the apparatus, for practicing the method according to the invention. A data source—shown schematically at 40 in each of FIGS. 1 through 3—typically is in the form of a data tape, and has selective fields thereon which provide the variable information required for the imaging process. An indicator (selectable criteria) is encoded on the data tape 40 for each header page (bill) to be printed.

The system of FIGS. 1 through 3 also includes a first computer, shown schematically at 41 in FIGS. 1 through 3. The first computer 41 includes a data processing and control system which is capable of driving high speed print devices simultaneously. The preferred first computer 41 comprises an XL DATA SYSTEM™ available from Moore Business Forms, Inc. of Lake Forest, Ill., and including a high speed data transfer module (HDT)—see the schematic illustration at 42 in FIG. 2—and connected up to an operator terminal 43 (see FIGS. 2 and 3). For example the operator terminal 43 may include a 200 megabyte hard disk drive, a 3.5 inch, 1.44 megabyte floppy disk, an interface board for the HDT, and an interface for communications with off-line document configurations, such as are provided in the second computer 44 illustrated in FIGS. 1 and 3. The HDT 42 ensures data integrity by overseeing separate checksum procedures.

The first computer 41 is typically connected by a general purpose interface (GPI) bus—as seen at 45 in FIG. 2—to the computer 41 and an individual ion deposition print unit 10 (a separate bus 45 being provided for each print unit) using raster image processor (RIP) 46. The information is typically transferred over bus 45 at one megabyte per second through a single cable link.

The RIP 46, which contains and utilizes RIFC processors, is responsible for rendering a bit-map (bit-image) of a page to be printed corresponding to the document specifications file for a given device. The RIP 46 is composed of a number of modules and dedicated blocks of memory to perform specific functions. The major modules include a master controller which controls overall synchronization between all other components, a registration module which synchronizes imaging with web travel and provides conditioning of incoming registration signals to eliminate effects of noise and reverse creeping (registration modes and input include an optical scanner which senses a pre-printed mark, a traction driven encoder, a raster or pitch encoder, and a top-of-form signal generator), a font image memory which is a block of memory reserved for the storage of fonts, images, and patterns (for filled areas), and an engine control model which transfers rasters to the print engine system 10 in synchronization with the web movement. The commands from RIP 46 are transferred—as indicated schematically by line 47 in each of FIGS. 1 through 3—to the ion deposition print system 10.

The computer 41 also indirectly controls the flexo units 24. The computer 41 controls form lag (the time and distance between each control device that performs a function on a common form in the production line when handling the web 17). The signal for form lag is transmitted—as indicated schematically at 49 in FIGS. 1 through 3—to an auxiliary device controller (ADC) 50. The ADC 50 provides an initiation signal to microprocessor controller (second computer) 44, for each of the flexo units 24. Each of the flexo units 24 is controlled independently. Once initiated, the microprocessor 44 is used to accurately control the length of the flexographic plate 27 engagement, on/off signal compensation, and web speed-following. On-screen adjustment—using the monitor 51 (see FIG. 3)—may be made of the flexographic print pattern using the microprocessor 44. Typically a separate pattern for each unit 24 is programmed into the microprocessor controller 44. The patterns are selected by the initiation signal input from the ADC 50. Each flexographic unit 24 then functions independently by engaging and disengaging (utilizing throw-offs 36) each plate cylinder 27 for selected program length. This can be changed by inputting information into the computer/microprocessor 44, utilizing any suitable inputting means, such as electronic transfer, a mouse, or the keyboard 52 (see FIG. 3). The ADC 50 may be located in the same housing as the microprocessor 44—as schematically illustrated in FIG. 3—or there may be a separate connection between them, shown schematically interconnected by line 53 in FIGS. 1 and 2.

While a wide variety of variations are possible, one exemplary arrangement of apparatus that is particularly suitable is illustrated schematically in FIG. 3. In the schematic illustration in FIG. 3 a second ion deposition unit 10' (preferably substantially identical to the unit 10, such as a MIDAX® unit) is provided, both the units 10, 10' printing variable information (e.g. of different types) on the same face of the web, or if turn bars are utilized printing on different faces of the web 17.

Following the direction of web 17 movement—as indicated by arrow 56 in FIG. 3—the first component provided is a conventional web unwind device 57, connected through a conventional metered in-feed unit 58 to the second ion deposition print unit 10', which has a fusing station 22' associated therewith. A monitor 59 also may be provided at the MIDAX® station 10' (and a similar monitor 59 at any other ion deposition station). Then the web 17 passes to the first flexo unit 24, with Lw curing, and then preferably to a first video inspection station 59'. The video inspection station 59 may be of any suitable type, but preferably is one available from PROMARK, which are widely used in the United States and in fact the entire world. The video inspection station 59' also is preferably controlled by the first computer 41, as indicated schematically by line 60 in FIG. 3.

Downstream of the first video inspection system/unit 59' in the direction 56 is the first ion deposition print unit 10, with associated fusing station 22. Downstream of that are one or more (preferably two in the embodiment illustrated in FIG. 3) flexo units 24 with built in UV curing, and downstream of them is a second video inspection system 59" like the system 59' and. controlled by the computer 41 as illustrated schematically by the line 60' in FIG. 3. Downstream of the video inspection station 59" is a paper web handling unit. The paper web handling unit may comprise cutting, slitting, punching, perforating, and/or other conventional components, such as components which can separate the web 17 into individual, discrete multi-page (e.g. even 3–8 pages long) documents (such as phone bills each having their own header, customer information, usage, and charging information, etc.) on site. Preferably, however, such separating and like functions are practiced at a different location (off site), and the preferred paper web handling unit of the equipment of FIG. 3 preferably comprises a conventional pull-roll module 62 and a conventional web rewind unit 63. The print line illustrated in FIG. 3—and shown schematically by reference numeral 64—typically has a length of about 12 meters.

The equipment of FIG. 3 can be operated not only accurately but at high speed. Accurate complete printing and handling speeds of over 300 feet per minute are typical, with speeds of 330 feet per minute or more also readily achievable and speeds of 500 feet per minute possible.

Figure 7:
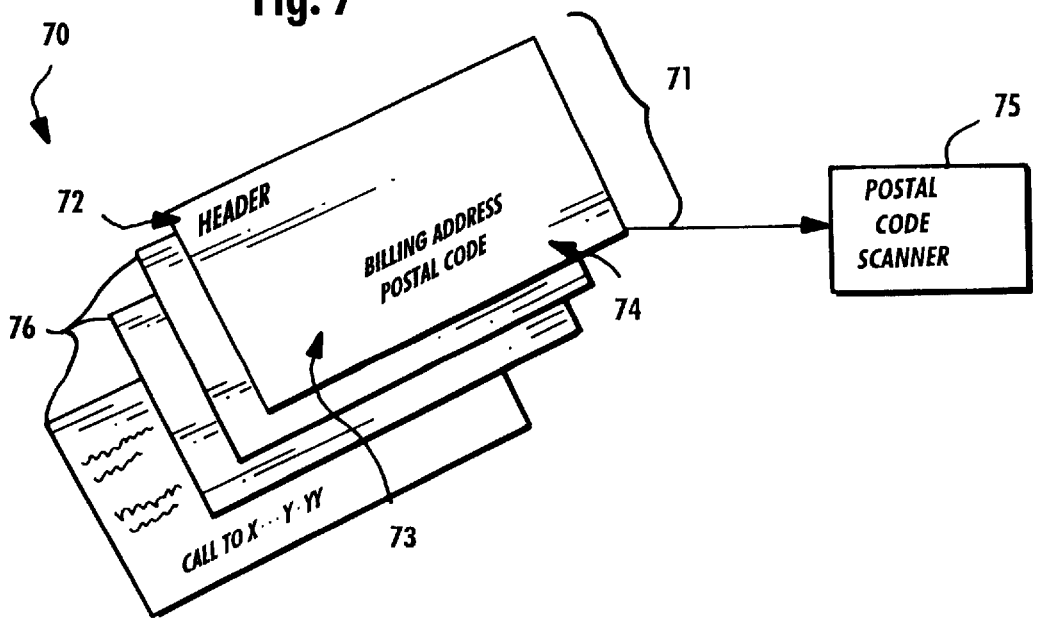
FIG. 7 is a schematic view of an exemplary discrete document produced according to the invention, which may be utilized with a conventional postal code scanner.

When the web 17 is separated into discrete documents 70—an exemplary one illustrated in FIG. 7—having a first page 71 with a header 72 and typically including a billing address 73 including postal code 74, each document 70 is already collated and may be readily sorted by postal code 74 using a conventional scanner (shown schematically at 75 in FIG. 7) either before or after separation of the web 17 into discrete documents 70. The documents 70 may easily be constructed as multi-page documents with subsequent pages 76 containing billing or like information. Three or more pages 71, 76 (e.g. up to eight pages) may readily be provided, with each document 70 sorted by postal code 74, without the necessity of matching discrete pages from different locations (as is practiced in the prior art). Each document 70 is preferably placed in a conventional window envelope (not shown) for mailing.

While the invention has been herein shown and described in what is presently conceived to be the most practical and preferred embodiment thereof it will be apparent to those of ordinary skill in the art that many modifications may be made thereof within the scope of the invention, which scope is to be accorded the broadest interpretation of the appended claims so as to encompass all equivalent methods and devices.

What is claimed is:

1. A method of printing a web of paper to produce discrete documents with selective non-variable information and vastly different variable information on portions of the paper web ultimately to be separated into discrete documents having a variable number of pages per document, utilizing at least one ion deposition print unit and a plurality of flexographic print units, a data source containing at least the variable information, and first and second computers, comprising the steps of:

(a) reading data from the data source with the first computer;

(b) in response to the read data from the data source, controlling the ion deposition print unit with the first computer to print variable information on the paper web;

(c) providing form lag commands from the first computer to the second computer; and (d) in response to the form lag commands, independently controlling the flexographic print units with the second computer to operatively engage and disengage the paper web and thereby print non-variable information from at least one of the flexographic units on each discrete document portion of the paper web, and to produce documents with variable numbers of pages; and wherein steps (a) through (d) are practiced at a web speed of at least about 330 feet per minute.

2. A method as recited in claim 1 comprising the further step of UV curing ink applied with each of the flexographic units substantially immediately after it has been applied.

3. A method as recited in claim 2 comprising the further step of video inspecting the web after application of the variable and non-variable information.

4. A method as recited in claim 1 wherein the ion deposition unit comprises a first ion deposition unit, and further comprising a second ion deposition unit; and comprising the further step of (e) in response to the read data from the data source, controlling the second ion deposition print unit with the first computer to print variable information on the paper web.

5. A method as recited in claim 4 comprising the further step of video inspecting the web before printing thereof with the first ion deposition unit and after printing with the second ion deposition unit, and separately after printing with all print units.

6. A method as recited in claim 1 wherein steps (a)–(d) are practiced to print phone bills, and wherein headers and standard information are printed by the flexographic units, and wherein phone calls made, customer, and charging information are printed by the ion deposition unit.

7. A method as recited in claim 6 wherein steps (a)–(d) are further practiced to produce documents having three or more pages, and including a postal code printed on a first page on which the header is printed, and further comprising the step of separating the multi-page documents by postal code.

8. A method as recited in claim 1 wherein steps (a)–(d) are further practiced to produce documents where at least some of the documents have three or more pages, and include a postal code printed on a first page on which a header is printed; and further comprising the step of separating the multi-page documents by postal code.

9. A method as recited in claim 1 wherein the second computer has a video monitor and input device, and comprising the further step of re-configuring the control of the flexographic print units by inputting information into the second computer using the input device, and viewing the inputted information and results of inputting the information using the video monitor.

10. A method as recited in claim 1 wherein the paper web has first and second faces, and comprising the further step of turning the web so that the relative positions of the first and second faces reverse between two of the flexographic print units.

11. A printing system for substantially simultaneously printing a web of paper to produce discrete documents with non-variable information and vastly different variable information on portions of the paper web ultimately to be separated into discrete documents, comprising:

a paper web unwind unit;

at least one ion deposition print unit operatively connected to the paper web unwind unit;

a plurality of flexographic print units located on the opposite side of the ion deposition print unit from the paper unwind unit, and operatively connected to the paper unwind unit;

a paper web handling unit on the opposite side of said flexographic print units from said ion deposition print unit;

a data source containing at least the variable information;

first and second computers, the first computer for reading data from said data source; and interconnections between said first computer and said ion deposition print unit and said second computer, and between said second computer and said flexographic print units, effecting, in response to the read data from the data source, control of the ion deposition print unit with the first computer to print variable information on the paper web; providing form lag commands from said first computer to said second computer; and in response to the form lag commands, independently controlling said flexographic print units with said second computer to operatively engage and disengage the paper web.

12. A printing system as recited in claim 11 wherein said paper web handling unit comprising a pull roll module and a paper web rewind.

13. A printing system as recited in claim 12 further comprising a video inspection unit disposed between said flexographic print units and said paper web rewind for inspecting printing on the paper web.

14. A printing system as recited in claim 11 wherein said ion deposition print unit comprises a toner hopper, toner developer roll, image cylinder, ion cartridge, pressure roll, cleaning station, and erase rod, the paper web passing between the image cylinder and the pressure roll, and the developer roll upstream of the image cylinder in the direction of paper web movement, and the cleaning station and erase rod downstream of the image cylinder in the direction of paper web movement.

15. A printing system as recited in claim 11 wherein each of said flexographic print units contains a self-contained UV curing unit for curing ink applied to the paper web thereby with ultraviolet radiation.

16. A printing system as recited in claim 15 wherein each flexographic print unit comprises an ink metering roll engaging an anilox roll, an impression cylinder, and a plate cylinder having a flexible material plate around at least part of the periphery thereof, said plate on said plate cylinder engaging said anilox roll, and the paper web passing between said plate on said plate cylinder and said impression cylinder.

17. A printing system as recited in claim 11 wherein said ion deposition unit comprises a first ion deposition unit; and further comprising a second ion deposition unit, and a first of said flexographic print units between said web unwind and said first ion deposition unit, and at least a second and third of said flexographic print units between said first ion deposition unit and said paper web handling unit.

18. A printing system as recited in claim 17 further comprising first and second video inspection units, said first video inspection unit between said second and first ion deposition print units, and said second video inspection unit between said flexographic units and said paper web handling unit.

19. A printing system as recited in claim 11 further comprising a raster image processor between said first computer and said first ion deposition unit.

* * * * *